United States Patent [19]

Woolnough et al.

[11] 4,418,739

[45] Dec. 6, 1983

[54] INSULATING WINDOW COVERING

[75] Inventors: James Woolnough, Brattleboro; Bruce Gardner, Guilford, both of Vt.; David A. May, Brookline, Mass.

[73] Assignee: Appropriate Technology Corporation, Brattleboro, Vt.

[21] Appl. No.: 339,334

[22] Filed: Jan. 15, 1982

[51] Int. Cl.[3] ..... A47H 11/06; E06B 9/171

[52] U.S. Cl. ..... 160/120

[58] Field of Search ..... 160/120, 121, 238, 239, 160/241, 85, 86, 122, 41, 271–273

[56] References Cited

U.S. PATENT DOCUMENTS

| | | | |
|---|---|---|---|
| 2,381,542 | 8/1945 | Hyatt et al. | 160/DIG. 7 |
| 2,581,433 | 1/1952 | North et al. | 160/120 |
| 3,789,904 | 2/1974 | Takazawa | 160/120 |
| 4,194,550 | 3/1980 | Hopper | 160/121 R |
| 4,333,511 | 6/1982 | Johnston | 160/271 |
| 4,341,254 | 7/1982 | Schaller et al. | 160/172 |

FOREIGN PATENT DOCUMENTS

| | | | |
|---|---|---|---|
| 2223542 | 11/1974 | France | 160/238 |

*Primary Examiner*—Peter M. Caun
*Assistant Examiner*—Cherney S. Lieberman
*Attorney, Agent, or Firm*—Wolf, Greenfield & Sacks

[57] ABSTRACT

An insulating shade including a channel-type frame which is designed to be permanently installed on the prime window frame. The shade assembly which is mounted in the frame includes a pair of rollers which are geared together so as to rotate simultaneously and simultaneously either take up or play out the shade material. The rollers with the shade are supported on bearing plates which in turn are hung on spring brackets that snap into the channels permanently secured to the window frame. A cord operated pulley carries a gear which in turn drives the two rollers so as to raise and lower the shade. Weather stripping is secured inside the channels of the frame, which cooperate both with the sides of the shade itself and the weighted roller at the bottom of the shade to prevent cold air from flowing about the shade.

13 Claims, 19 Drawing Figures

INSULATING WINDOW COVERING

This invention relates to window coverings and more particularly comprises a new and improved insulating shade assembly which is both functional and attractive.

Conventionally, prime windows are insulated by the installation of storm windows either on the inside or outside of the structure. Recently, substantial evidence has been discovered which suggests that more effective protection against heat loss may be achieved by providing insulation with a higher R value than glass or plastic, and this has led to the development of insulating shades which may be rolled up and down in the fashion of conventional window shades.

Several different factors must be considered in the design of an acceptable product. First, the shade must be esthetically appealing. Many people find that a quilted fabric is obtrusive when mounted within the window frame. Many of the insulated shades now available are so thick that when rolled up in the manner of a conventional window shade, they form a roll three inches or more in diameter, which cannot be effectively housed within the frame or be attractively mounted on the outer frame surface. Shades that are made up of several layers carried on a single roller may also be too thick. And shades with a single layer expose their unesthetic face outward to the observer, and moisture condensation on the material diminishes the effectiveness of the shade.

To be saleable, an insulating shade must also be relatively easy to install and economically competitive with other types of window coverings.

One important object of this invention is to provide an insulating window shade assembly with a high R value and which is attractive and easy to install.

A more specific object of the present invention is to provide an insulating window shade which does not include large or bulky rollers, but rather is capable of storing the shade material in the relatively small space.

Another important object of this invention is to provide a insulating shade assembly which, although made for a particular window size, nevertheless has large dimensional tolerances.

Another important object of this invention is to provide an insulating shade assembly that can be mounted in a window frame with merely a few screws and therefore requires only a screwdriver for installation.

SUMMARY OF INVENTION

The insulating shade of the present invention includes a channel-type frame which is designed to be permanently installed on the prime window frame. The shade assembly which is mounted in the frame includes a pair of rollers which are geared together so as to rotate simultaneously and simultaneously either take up or play out the shade material. The rollers with the shade are supported on bearing plates which in turn are hung on spring brackets that snap into the channels permanently secured to the window frame. A cord operated pulley carries a gear which in turn drives the two rollers so as to raise and lower the shade. Weather stripping is secured inside the channels of the frame, which cooperate both with the sides of the shade itself and the weighted roller at the bottom of the shade to prevent cold air from flowing about the shade.

These and other objects and features of this invention will be better understood and appreciated from the following detailed description of one embodiment thereof, selected for purposes of illustration and shown in the accompanying drawings.

BRIEF FIGURE DESCRIPTION

DETAILED DESCRIPTION OF THE DRAWINGS

Figure 1:
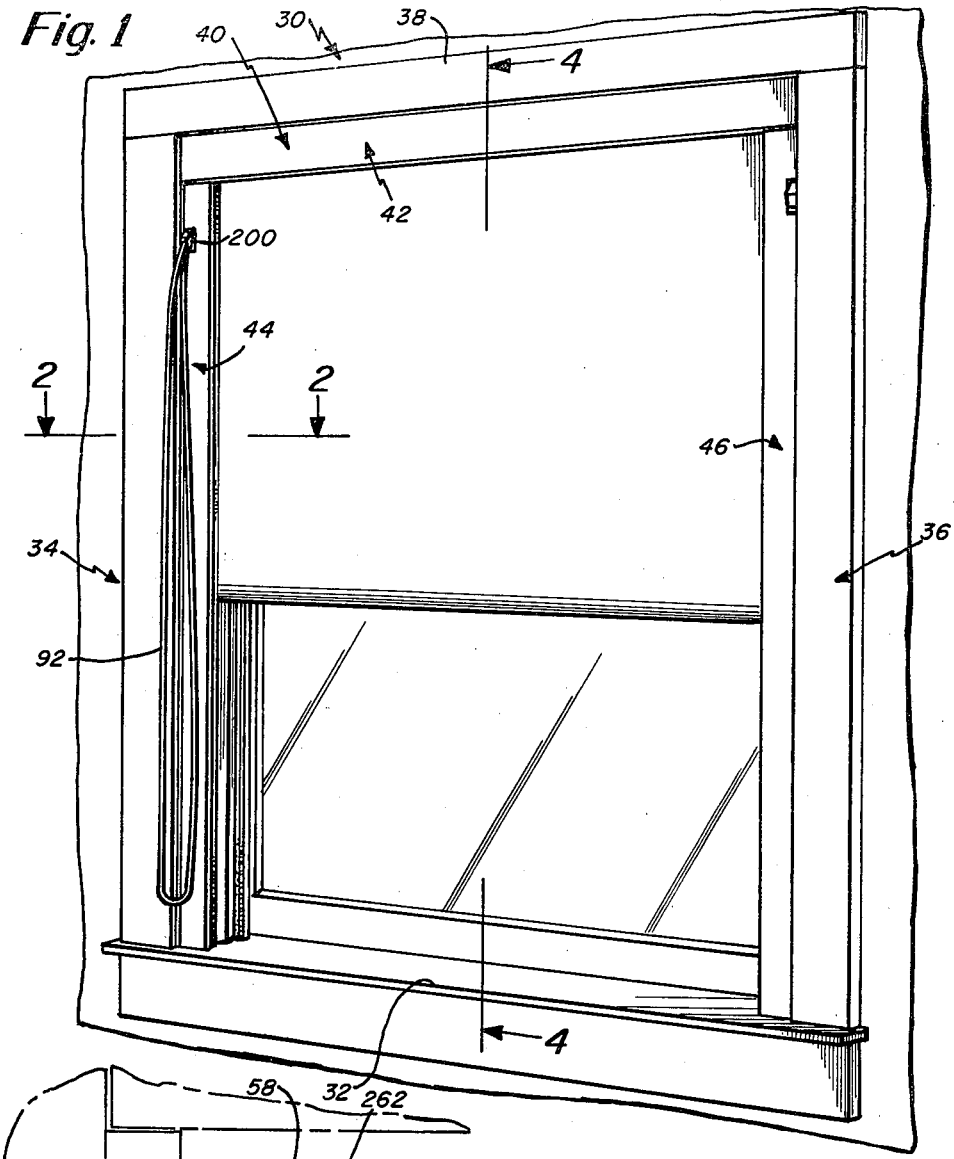
FIG. 1 is a perspective view of a window seen from the inside, on which the insulating shade assembly of the present invention is installed.

The insulating shade assembly of the present invention is shown in FIG. 1 installed within a window frame 30 that includes a sill 32, left and right jambs 34 and 36 and a lintel 38. The window itself may be a conventional double-hung window or be of any other form. The window configuration per se is no part of the present invention.

The insulating shade assembly 40 is mounted within the window frame 30 by means of a top U-shaped channel 42 secured to the bottom surface of the lintel 38 and left and right side U-shaped channels 44 and 46 secured to the facing surfaces of the jambs 34 and 36. While the channels 42, 44 and 46 are shown mounted within the frame, it is to be understood that they may be mounted on the front faces of the lintel and jambs so as to project into the dwelling or other building in which the shade is installed. In the following description, the side of the shade assembly viewed from inside the structure will be deemed to be the front and the side facing the window sashes covered by the shade will be called the rear or back of the assembly.

The insulating shade assembly in part is distinguished by the double roller assembly that supports the shade material. The roller assembly, the manner in which the roller assembly is installed, and the operating mechanism for raising and lowering the shade within the assembly frame defined by the channels 42, 44 and 46 are described below.

Figure 4:
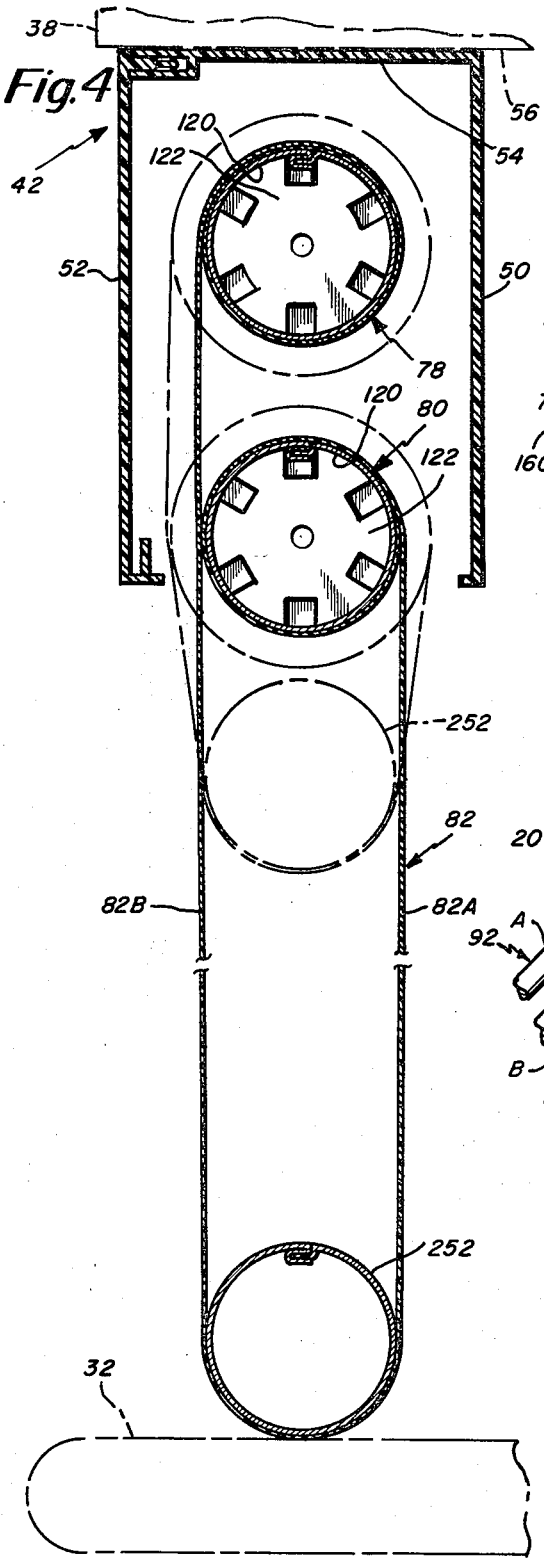
FIG. 4 is a cross sectional view, partly broken away, of the shade assembly, taken along the section line 4—4 in FIG. 1.

The top channel 42 shown in detail in FIG. 4 includes back and front vertical legs 50 and 52 and top leg 54. Top leg 54 is secured as shown in FIG. 4 to the bottom surface 56 of the lintel 38. The side channels 44 and 46 which are mirror images of one another include back and front legs 58 and 60 and outside legs 62 that are secured to the facing surfaces 64 of the jambs 34 and 36. The back legs 50 and 58 of the top and side channels are essentially coplanar as are their front legs 52 and 60.

Figure 10:
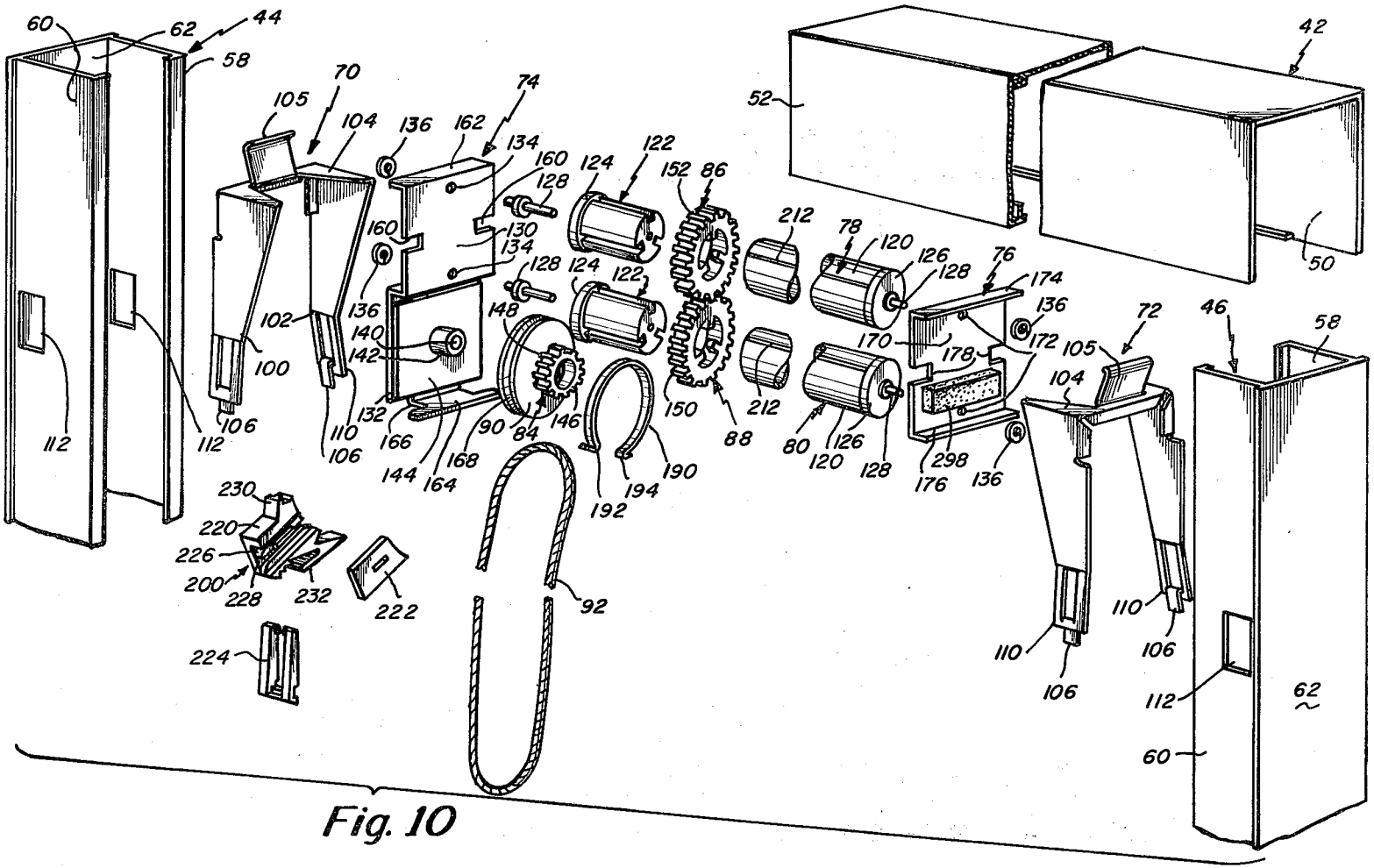
FIG. 10 is an exploded perspective view of the upper portion of the shade assembly but without the shade material, suggesting the manner in which the several parts are assembled.

The roller assembly which is supported within the channels is shown in exploded form in FIG. 10 and includes left and right spring brackets 70 and 72 which are identical, left and right bearing plates 74 and 76 which are of different configurations, upper and lower rollers 78 and 80 which are identical, flexible insulating shade 82 (see FIGS. 3 and 11), and actuating mechanism 84 for the roller assembly which includes upper and lower spur gears 86 and 88, pulley 90 and cord 92. These parts are described in substantial detail below.

Figure 6:
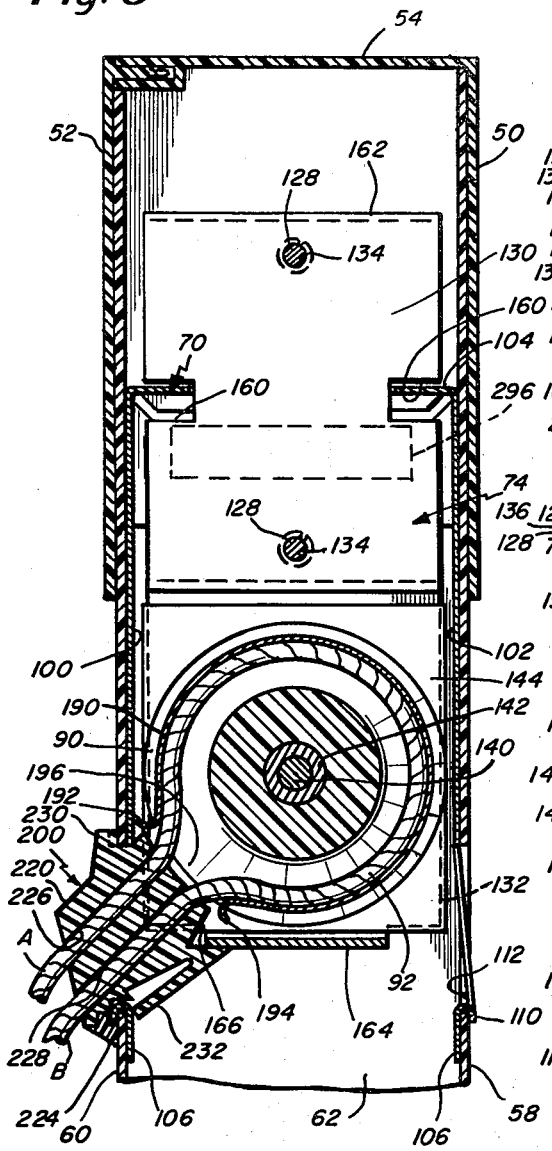
FIG. 6 is a cross sectional view showing details of the cord and pulley subassembly, taken along the section line 6—6 of FIG. 3.

As the spring brackets 70 and 72 are identical only bracket 70 will be described in detail. Bracket 70 includes a pair of parallel side arms 100 and 102 that are sized to lie just inside the inner surfaces of the legs 58 and 60 of the side channel 44 and an upper generally U-shaped horizontal panel 104 which joins the arms 100 and 102 at the top. A curved arm 105 extends upwardly from the side edge of the panel 104 and serves as a guide to slide over any fasteners in the side channel 44 when the shade assembly is installed in place. A strip 106 is bent out of the lower portion of each arm 100 and 102 and extends downwardly on the inside of the bracket arms, and they serve as clips or supports for the bracket within the side channel. The bracket is mounted within the channel by inserting the lower ends 110 of the arms through the openings 112 formed in the front and rear legs 60 and 58 of the channel causing the strip 106 to seat on the lower margins of the openings 112 as shown in FIG. 6.

Figure 5:
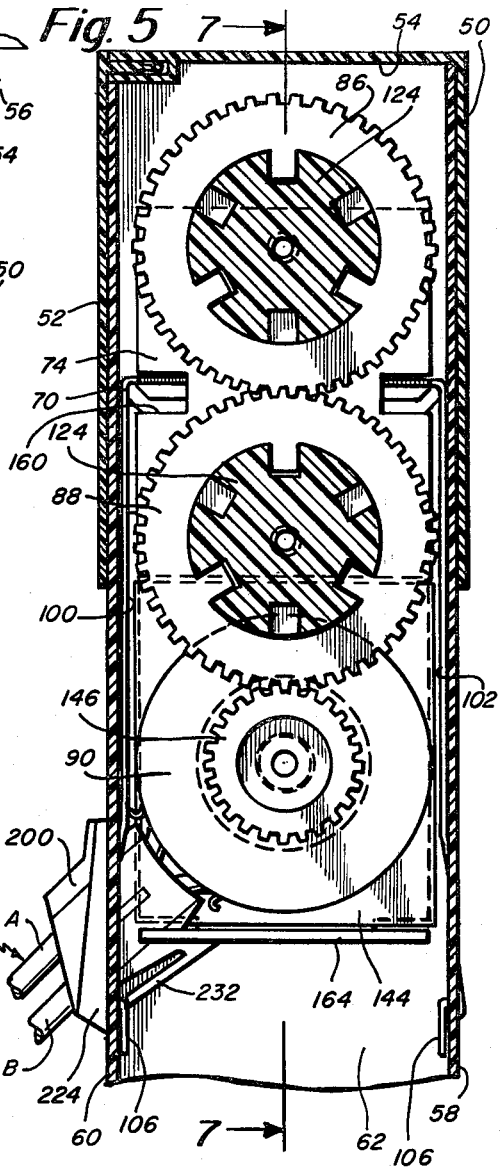
FIG. 5 is a fragmentary cross sectional view showing the drive subassembly, taken along the section line 5—5 of FIG. 3.
Figure 7:
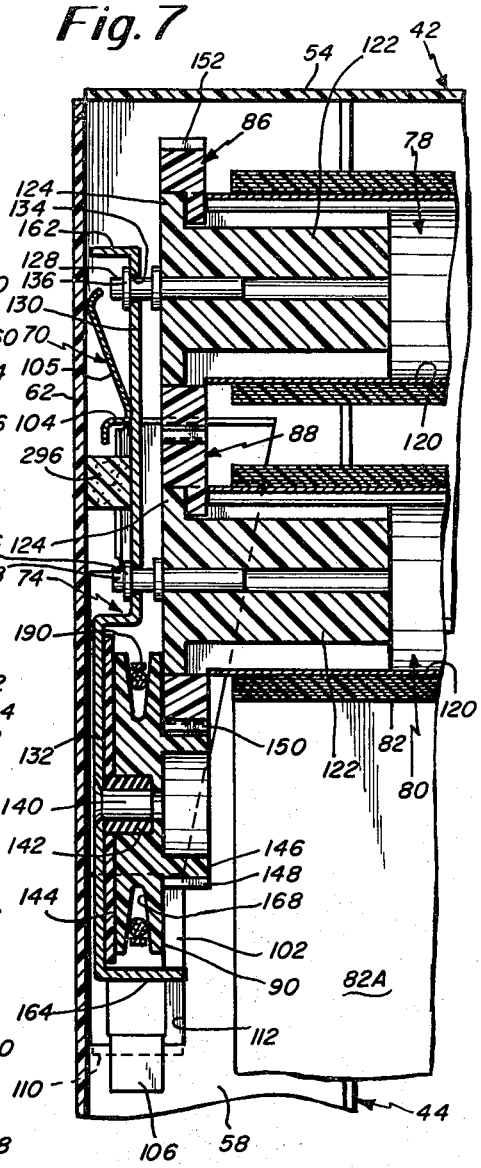
FIG. 7 is a fragmentary cross sectional view of the drive mechanism taken along the section line 7—7 of FIG. 5.
Figure 8:
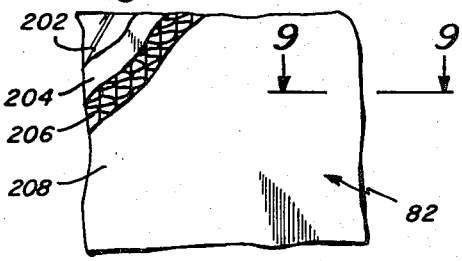
FIG. 8 is a fragmentary plan view of a partially delaminated patch of the shade material used in the assembly.
Figure 9:
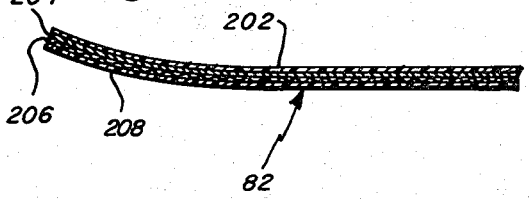
FIG. 9 is a cross sectional view of the shade material taken along the section line 9—9 of FIG. 8.

The rollers 78 and 80 are each composed of a tubular member 120 closed at the left end as viewed in FIG. 7 by a plug 122 which in turn carries one of the spur gears 86 or 88. The gears 86 and 88 are keyed to the periphery of the head 124 of their respective plugs by the square tooth configuration as shown in FIG. 5. The right end of each tube 120 is closed by a plug 126. Standard end pins 128 are supported on the heads of the plugs 122 and 126 and are coaxial with the tubes.

The assembled rollers 78 and 80 are supported by the end pins 128 directly on the bearing plates 74 and 76 at the left and right ends, respectively. Bearing plate 74 includes an upper vertical section 130 and a lower vertical section 132 which are offset horizontally from one another as clearly shown in FIGS. 7 and 10. The upper section 130 is provided with vertically aligned holes 134 through which the end pins 128 on the left end of the rollers extend and which are held in place on the plate section 130 by retainer clips 136. End pins 128 are inserted into the end caps 122 and 126 so that they are firmly attached to the rollers.

The lower section 132 of bearing plate 74 carries a fixed pin 140 having a bearing made of brass, fluro carbon plastic such as polytetrafluroethylene or other suitable material, on which the pulley 90 rotates. In FIG. 7 a thrust bearing 144 is also shown to assist in the smooth rotation of the pulley. Pulley 90 carries a small spur gear 146 that may be formed as an integral part of the pulley and whose teeth 148 mesh with the teeth 150 of the lower gear 88 on the lower roller 80. The teeth 150 of gear 88 in turn mesh with the teeth 152 of gear 86 on the upper roller 78.

Figure 12:
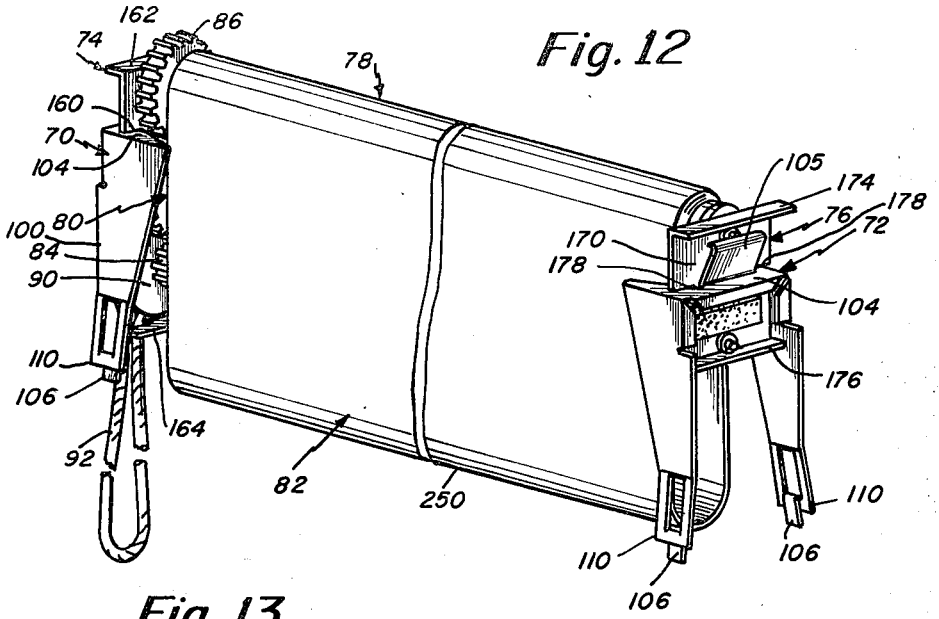
FIG. 12 is an enlarged perspective view of the shade assembly before installation in the channels mounted in the window frame.

A pair of opposite notches 160 are formed in the vertical edges of the upper plate section 130, and these notches are sized to receive the sides of the upper U-shaped panel 104, as is clearly shown in FIG. 12. The upper end of the end plate 74 has a horizontal flange 162 which lends stiffness to the plate and stabilizes the plate when positioned on the spring bracket in turn mounted in the channel 44. The lower end of the plate 74 is also provided with a horizontal flange 164 which lends stiffness to the plate. A notch 166 in the flange 164 adjacent the bottom of plate section 132 allows the cord 92 which engages the V-shaped notch 168 of pulley 90 to extend below the plate.

Bearing plate 76 that supports the right ends of the pulleys includes a main section 170 which is horizontally aligned with the section 130 in plate 74. Plate 76 has vertically aligned openings 172 that receive the free ends of the end pins 128 secured to the plugs 126. A pair of horizontal flanges 174 and 176 on the top and bottom of the plate 76 cooperate with the spring bracket 72 to position the plate in the channel 46. Notches 178 engage the sides of the upper panel 104 in substantially the same manner as do the notches 160 in the bearing plate 74 on the other side of the assembly.

As shown in FIGS. 6 and 7, the portion of the cord 92 which lies within the V-shaped groove 168 in pulley 90 is retained in the groove by means of a tension spring 190 that fits within the groove. The spring 190 extends about approximately 300° of the circumference of the pulley 90 and its ends 192 and 194 which are bent over, define a slot 196 between them through which the cord 92 extends away from the pulley. It it evident that the pulley 90 may be rotated in either direction by pulling either of the lines A and B of the cord.

The shade 82 in the preferred embodiment is a four-layer laminate having a low emissivity and thermal conductivity and is relatively thin, lightweight and attractive. The rear surface of the laminate is a clear thermoplastic coating 202 of high transparency to infra-red radiation which in turn is adhered to an aluminum layer 204 which in turn is secured to a woven polyester or fiberglass layer 206. The outer surface of the shade 82 is covered by a vinyl sheet material. The combined thickness of the laminate may be approximately 6–14 mils. The laminate is exemplary of the types of shade materials which may be used.

The shade has its opposite ends secured to the rollers 78 and 80, and the total length of the shade is approximately twice the height of the window to be insulated by it. The tube 120 of each roller is provided with a slot 212 through which the ends of the shade extend, and clips (not shown) are secured to the end edges of the shade within the tubes to hold the shades in place. To assemble the shade on the rollers, the clips are first secured to the ends, and the shade is then slipped in from one end of each roller before the plug at the end in each instance is mounted in place.

Figure 16:
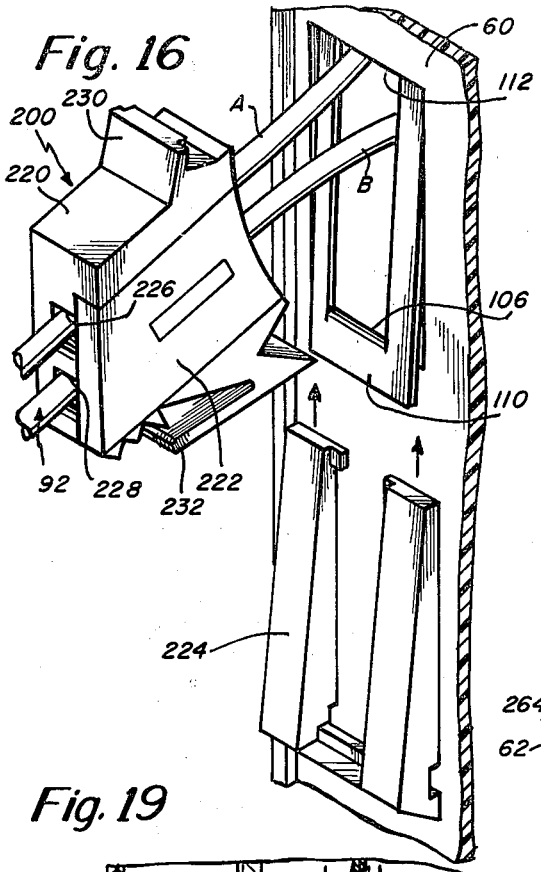
FIG. 16 is a fragmentary perspective view showing the cord clip fully assembled on the cord and prior to being installed in place in the channel of the assembly.
Figure 17:
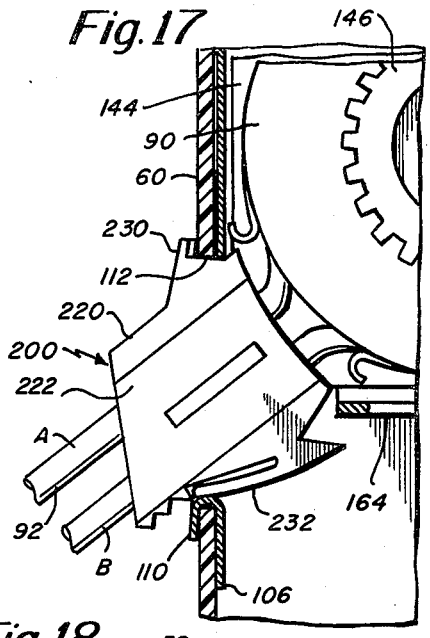
FIG. 17 is an enlarged fragmentary cross sectional view showing the cord clip being inserted in position within the channel of the shade assembly and before snapping into place as shown in FIG. 6.

As shown in FIG. 1, the cord 92 extends out the front leg 60 of channel 44 through the cord clip 200. The cord clip itself is composed of a main body 220 and a cover 222. The clip is supported in the opening 112 in the front leg 60 of the side channel 44 within a decorative bezel 224 shown in FIG. 10. The clip body 220 includes a pair of grooves 226 and 228 that receive the lines A and B, respectively, of the cord. If the cord 92 is endless, it is obvious that the lines A and B of the cord must be inserted into the grooves from the side and cannot be threaded into them. The cover 220 for convenience is removable and allows this to be done. Body 220 is provided with a shoulder 230 at its upper end that overlaps the upper margin of the opening 112 and a spring finger 232 along its bottom edge that acts as a barb so as to hold the clip in place when it is inserted through the opening 112. It is evident as shown in FIG. 6 that when the clip body is inserted through the opening 112, the spring finger 232 snaps behind the inner edge of the front leg 60 and bears against the strip 106 carried by the leg 100 of the spring bracket 70. The bezel 224 is shown in FIG. 16 to be generally U-shaped and slides up over the lines A and B and is positioned on the front face of leg 60 coextensive with the margins of the opening 112. After the bezel is mounted as shown in FIG. 16, the assembled cord clip 200 with its cover are mounted in place in the position shown in FIG. 6. When in place, the cord clip not only serves to support the cord and provide a smooth path for it leading to the periphery of the pulley, but in addition, the cord clip serves to retain the spring bracket 70 inside the channel.

Figure 11:
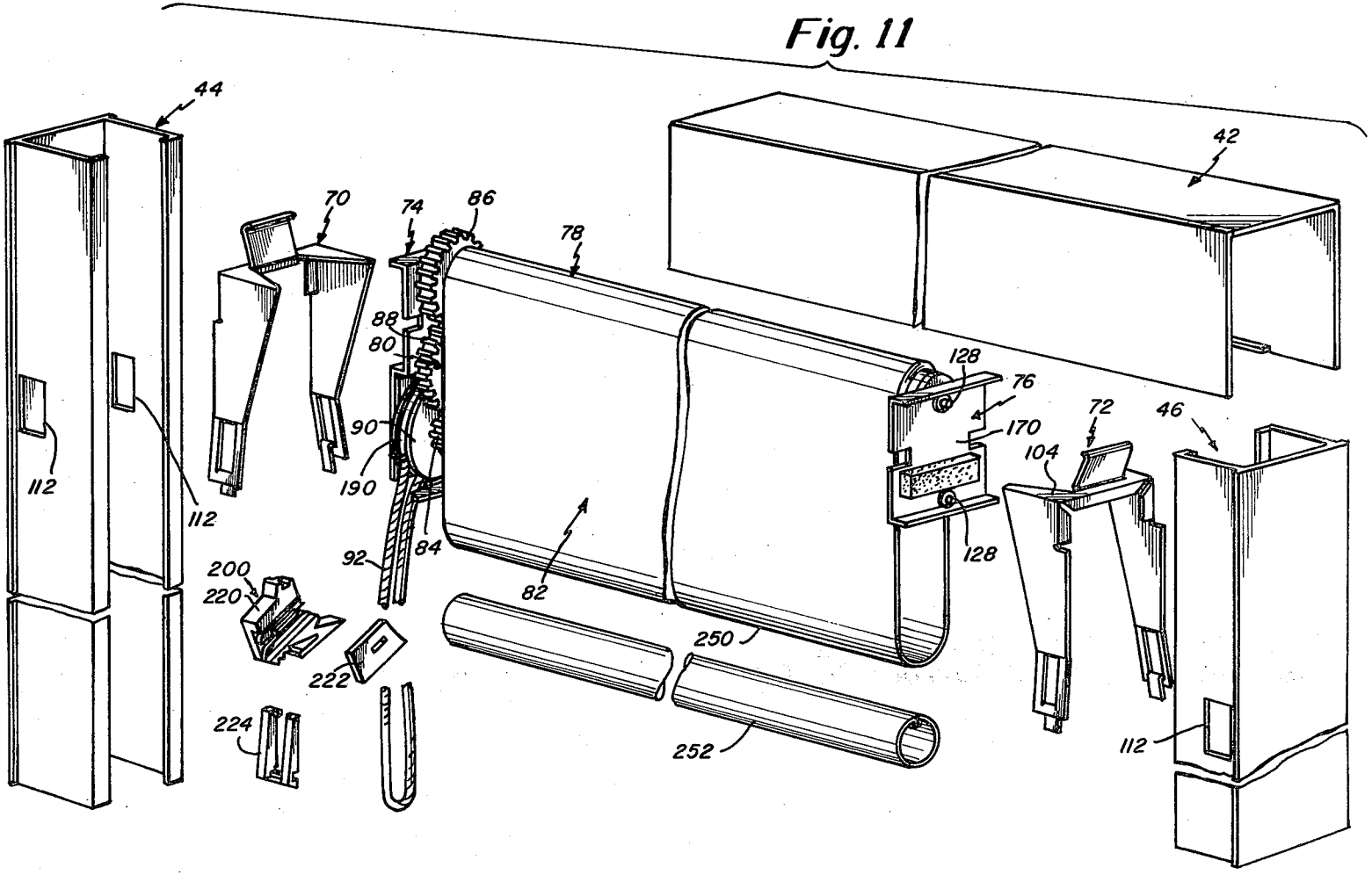
FIG. 11 is a partially assembled and partially exploded view of the shade assembly.

Because shade 82 when supported on the rollers is essentially folded at its middle as shown at 250 in FIG. 11, it is desirable to provide a weight in the form of a rod at the fold so as to cause the shade to hang straight within the frame defined by the channels. For this purpose, a rod 252 is provided that may be of any chosen configuration. As the two ends of the shade are rolled up evenly and at the same rate on their respective rollers, the weight 252 which may be in the form of a rod secured to the shade inside the fold may in fact be attached permanently to the shade material. It need not move with respect to the shade material, as both ends of the shade material on the rollers are taken up at the same speed on their respective rollers.

Figure 2:
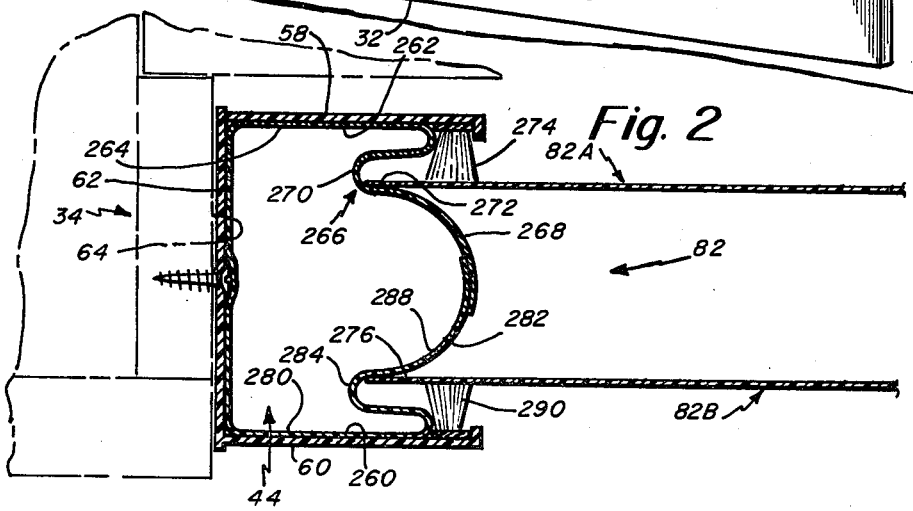
FIG. 2 is a fragmentary cross sectional view of the left side of the shade assembly shown in FIG. 1, taken along the section line 2—2 in FIG. 1.
Figure 18:
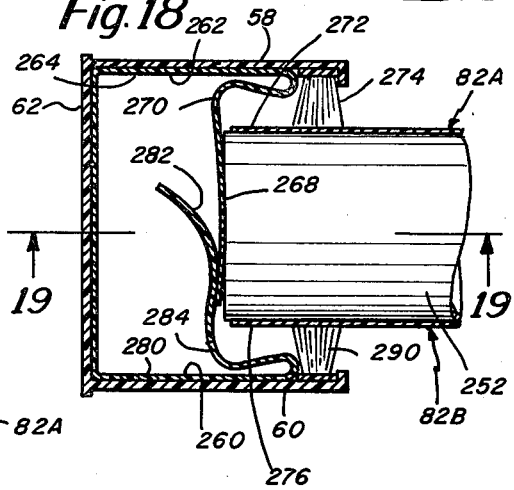
FIG. 18 is a fragmentary detail view of the side seals in the channel of the frame and showing how they seal against the weight roller at the bottom of the shade of the assembly.
Figure 19:
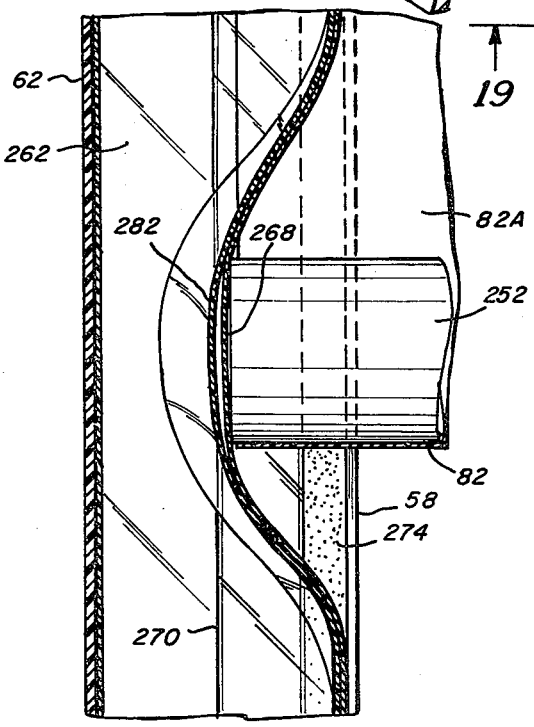
FIG. 19 is a fragmentary cross-sectional view of the assembly taken along the section line 19—19 of FIG. 18.

It is of course important that a seal be formed along the sides of the shade material if the assembly is to function as a most effective thermal insulator on the window covered by it. The seals may take a number of different forms. Their effectiveness may be somewhat hampered by the natural curl which tends to form along the side edges of the material. The seal is further complicated by the fact that between the rollers at the top and the weighted rod 252 at the bottom the shade material defines two spaced-apart sheets that do not in any way support one another, while at the bottom the sheets are essentially rigidly spaced apart by the diameter of the weighted rod. In FIGS. 2, 18 and 19, one embodiment of sealer subassembly is shown. In FIG. 2 the seal is shown as it is formed along the edges of the shade material where the shade material is unsupported by the rollers, and in FIGS. 18 and 19 the seal is shown about the bottom of the shade at the weighted end.

In FIG. 2 side channel 44 is shown screwed into the jamb 34. The front and rear legs 60 and 58 of the channel each carry flexible plastic strips 260 and 262, respectively. They extend substantially the full height of the channel from immediately below the lower roller 80 to the sill 32. In horizontal section, strip 262 includes a leg 264 secured to the inner surface of the rear leg 58 and a serpentine or "S"0 section 266 that serves as a flexible strip or fin against the rear panel 82A of shade 82. The serpentine section 266 includes an arcuate portion 268 which extends into the area between the rear and front panels 82A and 82B of the shade and a U-shaped portion 270 that engages the edge 272 of panel 82A. Panel 82A in turn is pushed against the U-shaped portion 270 of the strip by the weather stripping 274 mounted along the free edge of the rear leg 58 of the channel 44. While a brush-type weather stripping is illustrated, it may take other forms such as a flexible plastic foam or flexible extrusion. It is evident in FIG. 2 that the weather stripping 274 serves to push the edge 272 of the shade outwardly against the margin of the U-shaped portion 270 to close the gap between the shade and fin and form a seal along that edge. A similar arrangement is shown with respect to the edge 276 of the front panel 82B of the shade. The strip 260 has a section 280 secured to the rear face of front leg 60 of the channel and a flexible serpentine section 282 which defines a U-shaped portion 284 and an arcuate portion 288. Weather stripping 290 may also carried by the rear face of front leg 60 to cause the edge 276 to bear against the arcuate portion 288 of the strip so as to provide a substantially weather-tight seal around the edge 276 of the front panel 82B.

In FIGS. 18 and 19 the arcuate portions 268 and 282 of the strips 260 and 262 are shown to bear against the end face of the weighted roller 252 to form a seal about the lower end of the shade assembly. As the weighted roller 252 moves up and down during the raising and lowering of the shade, the arcuate portions 268 and 282 deflect so as to accept the presence of the roller while the portions of the strips 260 and 262 above the weighted roller maintain their normal configuration as shown in FIG. 2 and form seals along the side edges of the front and back panels of the shade.

Figure 13:
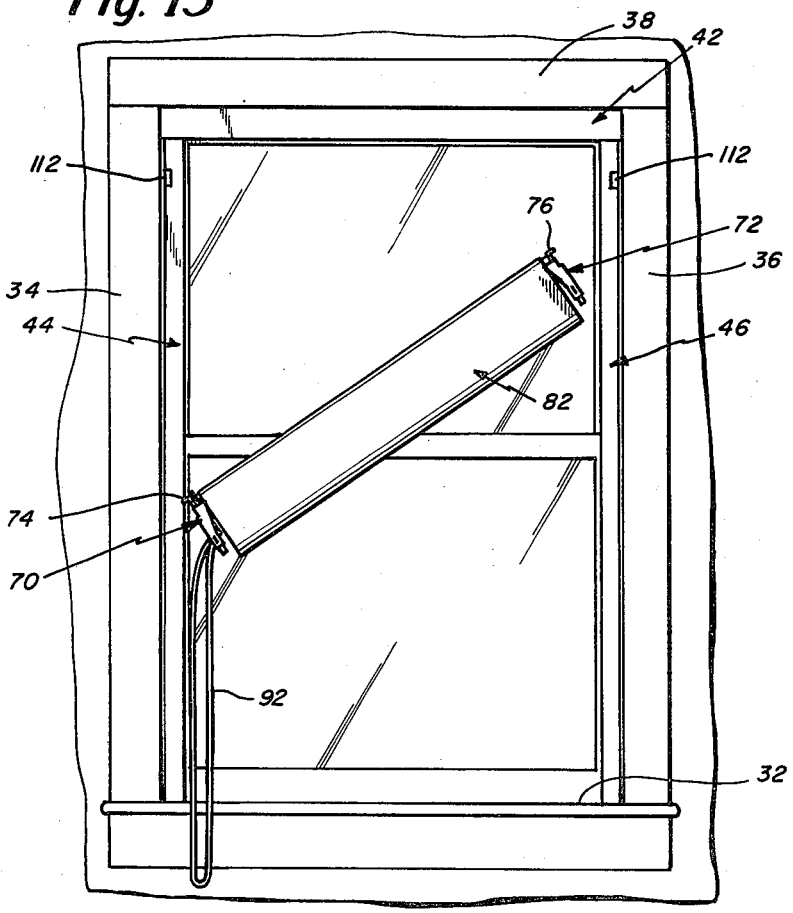
FIG. 13 is a front elevation view of a window showing the manner in which the assembly of FIG. 12 is tilted for installation in the channels within the frame.
Figure 14:
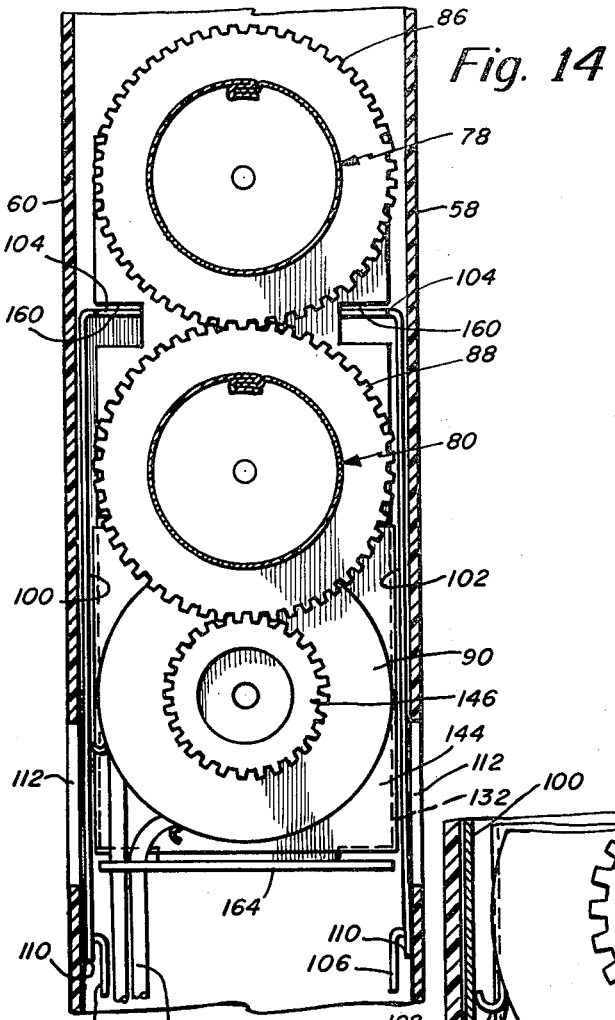
FIG. 14 is a schematic view of one end of the assembly of FIG. 12 positioned within the channel and showing the parts before the spring bracket is snapped into place and before the cord clip for the cord is installed.

The insulating shade assembly is installed within a window frame in the following manner: The installer first mounts the channels 42, 44 and 46 within the window frame 30 in the position shown in FIG. 1 or alternatively on the front faces of the window frame or on the wall about the window opening. Putty and/or shims may be used to compensate for irregularities in the surfaces on which the channels are mounted. The insulating shade assembly normally would be preassembled in the factory by attaching the shade material 82 to the tubes 120 of the top and bottom rollers 78 and 80, by attaching the plugs 122 and 126, end pins 128, gears 86 and 88, pulley 90, bearing plates 74 and 76, spring brackets 70 and 72, and by connecting cord 92 and spring clip 190, all as suggested in FIG. 12. The preassembled shade assembly is mounted within the frame defined by the channels 42, 44 and 46 by tipping the assembly in the manner shown in FIG. 13. With the various parts cocked as shown, the shade assembly is raised with the spring brackets inside the side channels to a position wherein the lower ends 110 of the legs 100 and 102 are aligned with the openings 112 and snap into place in them.

Figure 3:
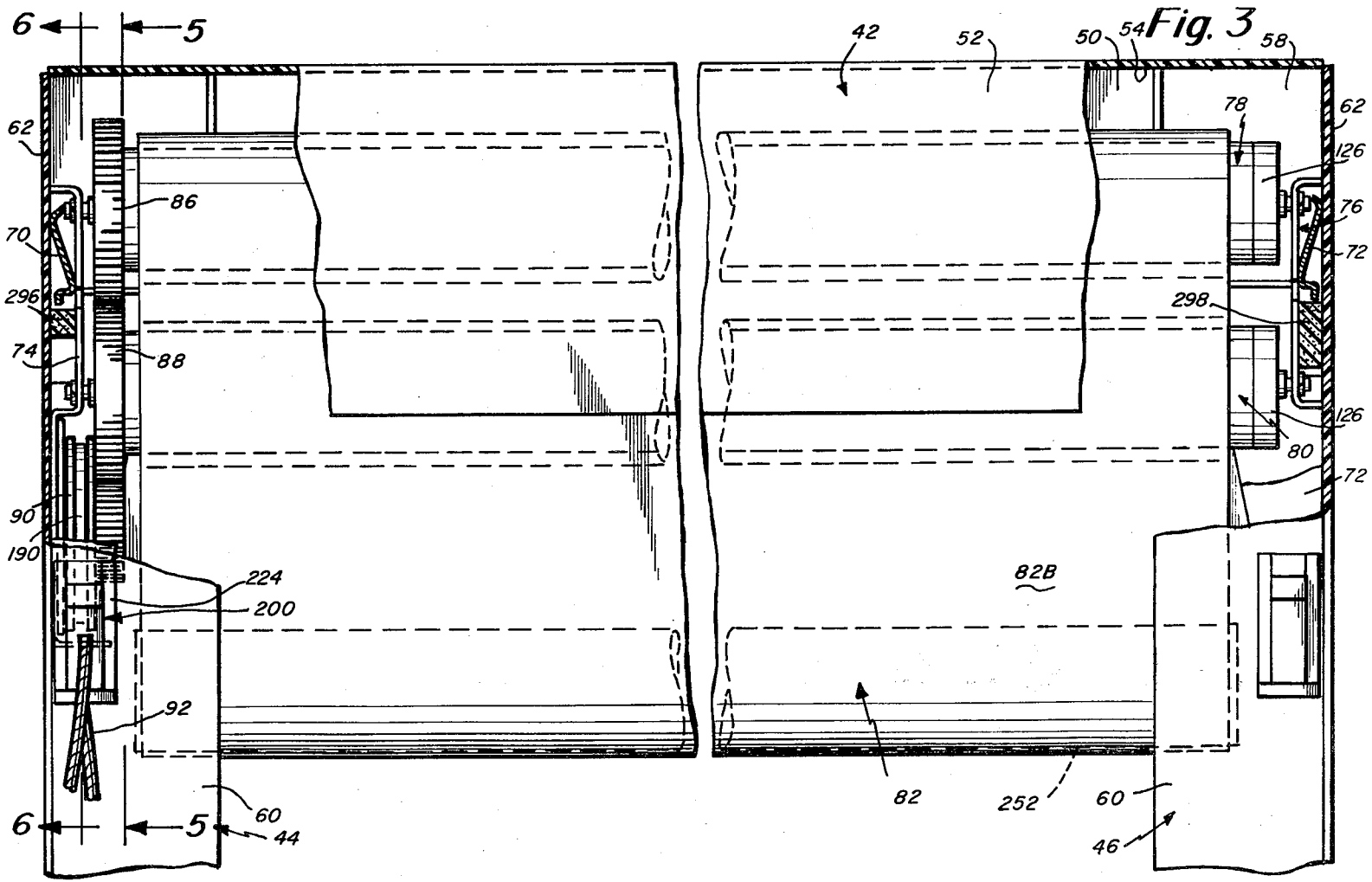
FIG. 3 is a front elevation view of the shade assembly with the upper part of the assembly frame broken away to expose much of the drive mechanism and with the shade partially raised.

In FIG. 3 it will be noted that a small, low density foam block 296 is positioned between the back of the upper portion 130 of the bearing plate 74 and the outside leg 62 of the side channel 44 and between the legs 100 and 102 of spring bracket 70. On the other side of the assembly, a larger and more dense foam block 298 is positioned between the back of bearing plate 76 and the outside leg of side channel 46. The larger and stiffer block 298 overpowers the lighter block 296 and pushes the assembly toward the left or gear end so as to maintain the three gears in alignment within the side channel 44. This arrangement will compensate for small variations in dimensions and will hold the assembly firmly in place within the channel frame.

Figure 15:
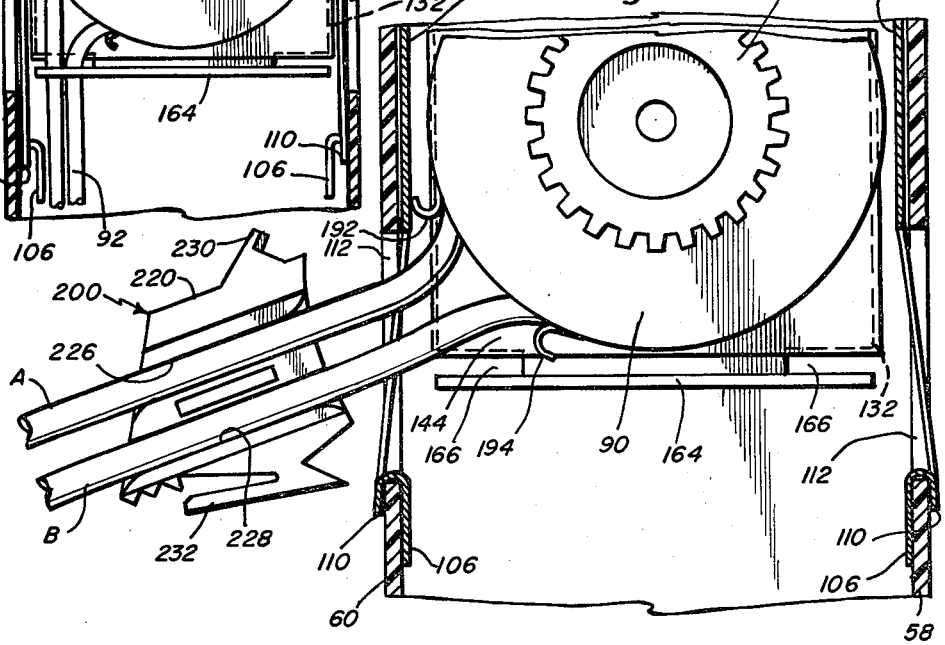
FIG. 15 is a detailed view showing the spring bracket in place and manner in which the main body of the cord clip is fastened to the cord and prior to the installation of the clip in the side channel of the shape assembly.

With the shade assembly positioned within the channels, the cord 92 on pulley 90 is threaded through the opening 112, and the cord clip 200 is then mounted on the cord as suggested in FIGS. 15 and 16. The bezel 224 is next positioned about the opening 112 and surrounding the lines A and B of the cord as shown in FIG. 16, and the cord clip 200 is then inserted through the opening 112 until its barb 232 locks behind the strip 106 as shown in FIG. 6. The weather stripping 260 and 262 carried by the channels of the frame may have previously been secured in place to the front and rear legs of each of the side channels 44 and 46 or alternatively the stripping may be secured in place after the shade assembly is installed in the manner just described.

It will be apparent that when the shade is installed, it is raised and lowered by pulling on the lines A and B of the cord. Because the diameters of the rollers 78 and 80 are the same and the numbers of teeth on the gears 86 and 88 are also the same, the two rollers turn at the same speed and wind and unwind the front and rear panels of the shade at the same rate. Therefore, when the lower roller is turned counterclockwise and the upper roller is turned clockwise as viewed in FIG. 4, in response to rotation of the pulley 90 by means of the cord 92, the shade material winds up on the two rollers, and the weighted roller 252 at the bottom rises from the window sill. As viewed in FIG. 5, this is achieved by pulling on the lower line B of cord 92. To lower the shade, the line A is pulled which causes the pulley as viewed in FIG. 5 to rotate counterclockwise, causing the lower roller 80 to turn clockwise and the upper roller 78 to turn counterclockwise. That rotation imparted to the rollers 78 and 80 causes each to unwind the portion of shade 82 wound on it and allow the weighted roller to move toward the sill.

Having described the invention in detail, those skilled in the art will appreciate that the shade of this invention is capable of forming a most effective insulating barrier on the inside of the window. When the shade is fully lowered, the weighted roller will rest on the sill and form a natural seal at the bottom while the side edges of the shade will engage the weather stripping 260 and 262 in each side channel 44 and 46. Because the shade material is taken up on two rollers rather than on a single roller, the channel at the top need not be obtrusively large so as to make the shade assembly unattractive in the window. The shade material itself is very thin which also is an important factor in avoiding unacceptably large channels. Obviously, a thick shade would create appreciable bulk at the top of the window frame when the shade is raised and therefore would not be esthetically appealing. The assembly is not difficult to install and the parts are not heavy and do not require motorization. In summary, the shade assembly of this invention provides a most effective insulating covering on the window with a high R factor while being attractive and easy to install.

From the foregoing description those skilled in the art will appreciate that numerous modifications may be made of this invention without departing from its spirit. Therefore, we do not intend to limit the breadth of this invention to the single embodiment illustrated and described. Rather, the scope of this invention is to be determined by the appended claims and their equivalents.

What is claimed is:

1. An insulating window shade assembly comprising a downwardly open, U-shaped top channel and a pair of opposed, inwardly open U-shaped side channels intended to be permanently secured on the inside of a window about the window opening, a bracket removably mounted adjacent the top of each side channel, a bearing plate mounted in each bracket and a pair of parallel rollers supported between the bearing plates one above the other, a pair of spur gears, one coaxially mounted on each roller, said gears engaging one another causing the rollers to rotate simultaneously and in opposite directions when one is actuated, a pulley mounted on one of the side channels and carrying a gear registering with the gear on one of the rollers and an endless pull cord looped around the pulley for rotating the pulley in either direction so as to impart rotation to each of the rollers, shade panels of flexible insulating material having their upper ends wound in opposite directions of the two rollers whereby rotation of the rollers will cause the flexible shade panels simultaneously to unwind from or wind onto the rollers, the lower ends of the shade panels being secured together, a weight secured to the lower ends of the shade panels urging the shade panels to hand vertically from the rollers, and sealing means in the side channels engaging the side edges of each of the shade panels for sealing the side edges of the shade panels within the window frame.

2. An insulating window shade assembly as defined in claim 1 further characterized by said shade panels rolling onto the outside of one of the rollers and the inside of the other of the rollers so that the shade forms two spaced apart panels separated by an air chamber.

3. An insulating window shade assembly as defined in claim 1 further characterized by said brackets, bearing plates, spur gears and pulley being confined within the side and top channels.

4. An insulating window shade assembly as defined in claim 3 further characterized by an opening in the side of one of the side channels, and a cord clip mounted in said opening and through which the cord can extend from the pulley to be exposed and available to the operator.

5. A shade assembly comprising a pair of closely spaced rollers with their axes in a common vertical plane and adapted to be mounted at the top of a window frame, end pins secured to the ends of the rollers, bearing plates engaging the pins for carrying the rollers, brackets releasably connected to the bearing plates for mounting the assembly;

a shade made of thermal insulating material with two spaced apart shade panels, the upper ends of the panels wound onto the two rollers and with the shade panels hanging down from the rollers, gears engaging one another and coaxially mounted on each roller interconnecting the two rollers causing them simultaneously to either roll up or play out the shade panels wound on them, when one of the rollers is rotated, a cord and pulley connected to said one of the rollers for imparting rotation to it for raising and lowering the shade panels, side channels adapted to be connected adjacent the sides of the window, said channels having front and rear vertical legs which receive the brackets between them and house the gears and pulley, an opening in the front leg of the channel housing the pulley, said cord extending from the pulley out the opening in the leg, and a cord clip mounted on the cord where the cord passes through the opening, said cord clip engaging the bracket it that channel and retaining it in place in said channel.

6. A shade assembly as defined in claim 5 further characterized by sealing means mounted in the channels for engaging the side edges of the shade panels for limiting the flow of air about the side edges of the panels.

7. A shade assembly as defined in claim 5 further characterized by said shade being a laminate including layers of aluminum fiberglass and thermoplastic.

8. A shade assembly as defined in claim 5 further characterized by resilient means disposed in the channels and pushing the rollers into the channel containing the pulley.

9. An insulating window shade as defined in claim 5 further characterized by means secured to the lower ends of the shade panels urging the shade panels to hang vertically from the rollers.

10. An insulating window shade assembly comprising:

a top channel and a pair of opposed, inwardly open U-shaped side channels intended to be permanently secured on the inside of a window about the window opening, a sub-assembly including a pair of parallel rollers each carrying a shade panel of flexible material wound in opposite directions on the rollers, spur gears mounted on the rollers and engaging each other causing the rollers to rotate simultaneously and in opposite directions when one is rotated, bearing plates supporting the ends of the rollers, a cord and pulley supported by one of the bearing plates and having a gear registering with one of the gears on the rollers to impart rotation to the rollers, and a pair of mounting brackets each supporting one of the bearing plates, and means provided in the side channels and the brackets enabling the subassembly to be snapped as a unit in place within the channels.

11. An insulating window shade assembly as defined in claim 10 further characterized by said U-shaped channels having front and rear legs and with the gears, cord and pulley disposed in the channels between the legs, an opening in the front leg of the channel housing the cord and pulley, said cord extending out the opening in the leg, and a cord clip mounted on the cord where the cord passes through the opening, said clip engaging the bracket in that channel and retaining it in place.

12. A shade assembly comprising:

a pair of closely spaced rollers adapted to be mounted at the top of a window frame, a shade made of thermal insulating material with two spaced apart shade panels, the upper ends of the panels wound onto the two rollers and with the shade panels hanging down from the rollers, means mechanically interconnecting the two rollers causing them simultaneously to either roll up or play out the shade panels wound on them, when one of the rollers is rotated, means including brackets supporting the rollers, a cord and pulley supported by one of the brackets and operatively connected to the rollers for imparting rotation to the rollers to raise and lower the shade panels, side channels adapted to be connected adjacent the sides of the window, said channels having front and rear vertical legs which receive the brackets between them and house the pulley, an opening in the front leg of the channel housing the pulley, said cord extending from the pulley out the opening in the leg, and a cord clip mounted on the cord where the cord passes through the opening, said cord clip engaging the bracket in that channel and retaining it in place in said channel.

13. An insulating window shade assembly as defined in claim 12 further characterized by sealing means in the side channels engaging the side edges of each of the shade panels for sealing the sides of the shade.

* * * * *